US011149474B2

(12) United States Patent
Ciccone et al.

(10) Patent No.: US 11,149,474 B2
(45) Date of Patent: Oct. 19, 2021

(54) ARTICULATING HOOD PIN ASSEMBLY AND HOOD LATCH ASSEMBLY INCORPORATING THAT ARTICULATING HOOD PIN ASSEMBLY

(71) Applicant: FORD GLOBAL TECHNOLOGIES, LLC, Dearborn, MI (US)

(72) Inventors: Thomas Joseph Ciccone, Madison Heights, MI (US); Greg B. Zinn, Canton, MI (US); Trenton McMillion, Roseville, MI (US); Jacek Brzozowski, Windsor (CA)

(73) Assignee: Ford Global Technologies, LLC, Dearborn, MI (US)

( * ) Notice: Subject to any disclaimer, the term of this patent is extended or adjusted under 35 U.S.C. 154(b) by 645 days.

(21) Appl. No.: 16/003,797

(22) Filed: Jun. 8, 2018

(65) Prior Publication Data

US 2019/0376326 A1 Dec. 12, 2019

(51) Int. Cl.
*E05B 83/24* (2014.01)
*E05B 85/04* (2014.01)
*E05B 85/20* (2014.01)

(52) U.S. Cl.
CPC ..... *E05B 83/24* (2013.01); *E05B 85/04* (2013.01); *E05B 85/20* (2013.01)

(58) Field of Classification Search
CPC ..... E05B 85/20; E05B 83/243; E05B 63/121; E05B 2015/0235; E05B 63/244; E05B 83/24; E05B 2063/0026; E05B 17/2011; E05B 83/16; E05B 85/04; E05B 15/006; E05B 15/022; E05B 47/06; E05B 85/22; Y10S 292/14; Y10S 292/53; Y10S 292/39; Y10S 292/40; Y10S 292/46; Y10S 403/06; Y10T 292/14; Y10T 292/696; Y10T 403/32631; Y10T 403/592; Y10T 16/524
See application file for complete search history.

(56) References Cited

U.S. PATENT DOCUMENTS 1,458,747 A * 6/1923 Carpmill ..... E05B 83/243 292/114
1,521,835 A * 1/1925 Reed ..... E05B 83/243 292/129
1,667,732 A * 5/1928 Henson ..... E05B 83/243 70/240
1,815,540 A * 7/1931 Black ..... E05B 83/243 180/69.2

(Continued)

FOREIGN PATENT DOCUMENTS

DE 10148426 C1 6/2003
KR 101242158 B1 3/2013
RU 62631 U1 4/2007

OTHER PUBLICATIONS

English Machine Translation of DE10148426C1.
English Machine Translation of KR101242158B1.
English Machine Translation of RU62631U1.

*Primary Examiner* — Mark A Williams
(74) *Attorney, Agent, or Firm* — Vichit Chea; King & Schickli, PLLC

(57) ABSTRACT

An articulating hood pin assembly includes a double-ended ball stud, a receiver, a retention element holding the double-ended ball stud and a snap ring securing the retention element in the receiver. A hood latch assembly includes a latch mechanism and the articulating hood pin assembly.

17 Claims, 5 Drawing Sheets

(56) References Cited

U.S. PATENT DOCUMENTS 1,931,850 A * 10/1933 Moore ..... E05B 83/243 292/113
3,210,105 A * 10/1965 Vogt ..... F16C 11/0633 403/140
3,860,277 A * 1/1975 Wang ..... E05B 47/0002 292/251.5
4,758,110 A * 7/1988 Ito ..... F16C 11/0638 403/122
4,875,794 A * 10/1989 Kern, Jr. ..... F16C 11/086 403/132
5,139,293 A * 8/1992 Zimmerman ..... E05C 17/56 292/251.5
5,904,436 A * 5/1999 Maughan ..... F16C 11/0642 403/140
6,077,011 A * 6/2000 Walker ..... F16B 21/165 24/453
6,129,411 A * 10/2000 Neff ..... B60P 3/42 296/193.03
6,151,754 A * 11/2000 Chen ..... E05C 17/52 16/85
6,394,211 B1 * 5/2002 Palenchar ..... B62D 25/10 180/69.21
6,584,642 B2 * 7/2003 Hodson ..... E05F 5/08 16/85
6,692,176 B1 2/2004 Fladhammer
8,585,340 B2 * 11/2013 Schmitz ..... F16B 5/065 411/512
8,960,734 B2 2/2015 Camp
9,611,679 B2 * 4/2017 Wollacott ..... E05B 15/0006
10,703,294 B2 * 7/2020 Dellock ..... F16B 21/125
10,815,709 B2 * 10/2020 Lovasz ..... B60J 7/194
2009/0172947 A1 * 7/2009 Orend ..... B29C 66/12441 29/898
2009/0288897 A1 11/2009 Louramore
2010/0237637 A1 * 9/2010 Camp ..... E05B 1/0038 292/358
2011/0101712 A1 * 5/2011 LaConte ..... E05B 17/0041 292/252
2013/0307280 A1 * 11/2013 Camp ..... E05B 17/0037 292/228
2015/0152665 A1 6/2015 Camp

* cited by examiner

ARTICULATING HOOD PIN ASSEMBLY AND HOOD LATCH ASSEMBLY INCORPORATING THAT ARTICULATING HOOD PIN ASSEMBLY

TECHNICAL FIELD

This document relates generally to the motor vehicle equipment field and, more particularly, to a new and improved articulating hood pin assembly as well as to a hood latch assembly incorporating that articulating hood pin assembly.

BACKGROUND

A motor vehicle incorporates a wide range of manufactured components. While attempts are made to minimize variation in those component parts by tolerance controls, a certain amount of build variation results from the additive effects from the various component part tolerances. This document relates to a new and improved articulating hood pin assembly that can better tolerate build variation and may be incorporated into a hood latch assembly providing for improved performance when latching a hood of a motor vehicle in a closed position.

SUMMARY

In accordance with the purposes and benefits described herein, a new and improved articulating hood pin assembly is provided. That articulating hood pin assembly comprises a double-ended ball stud, a receiver, a retention element holding the double-ended ball stud and a snap ring securing the retention element in the receiver.

The double-ended ball stud includes a shank extending between a first ball and a second ball. The receiver includes a cylindrical sidewall having a first end and a second end and an end wall closing the first end. The articulating hood pin assembly also includes a channel formed in the cylindrical sidewall adjacent the second end.

The retention element of the articulating hood pin assembly includes a first section and a second section joined together to form a spherical pocket. When the articulating hood pin assembly is fully assembled, the first ball at an end of the double-ended ball stud is received and captured in the spherical pocket. Further, the retention element is received within the cylindrical sidewall of the receiver.

The snap ring is received in the channel and projects from the channel to partially close the second end of the receiver and thereby capture the retention element within the cylindrical sidewall.

In some embodiments a water drain feature may be provided in the end wall of the articulating hood pin assembly.

The articulating hood pin assembly may also further include a mounting collar at the second end. Further, the articulating hood pin assembly may include a plurality of fasteners extending through a plurality of apertures in the mounting collar in order to secure the receiver to a supporting component of the motor vehicle.

In accordance with an additional aspect, a hood latch assembly is provided. That hood latch assembly comprises a latch mechanism and an articulating hood pin assembly displaceable between a locked position held within the latch mechanism and an unlocked position free of the latch mechanism. Further, the articulating hood pin assembly includes a double-ended ball stud, a receiver, a retention element holding the double-ended ball stud and a snap ring securing the retention element in the receiver.

The double-ended ball stud includes a shank extending between a first ball and a second ball. The first ball and second ball are provided at opposed ends of the shank.

The receiver includes a cylindrical sidewall having a first end and a second end as well as an end wall closing the first end. That cylindrical sidewall may further include a channel adjacent the second end.

The retention element includes a first section and a second section. When the articulating hood pin assembly is fully assembled, the first section and the second section are joined together to form a spherical pocket. The first ball at one end of the double-ended ball stud is received and captured in this spherical pocket. Further, the retention element is received in the cylindrical sidewall. In addition the snap ring is received in the channel and projects from the channel to partially close the second end of the receiver and capture the retention element within the cylindrical sidewall.

In one possible embodiment of the hood latch assembly, the latch mechanism is mounted to a hood of the motor vehicle and the receiver is mounted to a substrate or support surface within an engine compartment of the motor vehicle.

In the following description, there are shown and described several preferred embodiments of the articulating hood pin assembly and the hood latch assembly incorporating that articulating hood pin assembly. As it should be realized, the articulating hood pin assembly and the hood latch assembly are capable of other, different embodiments and their several details are capable of modification in various, obvious aspects all without departing from the articulating hood pin assembly and hood latch assembly as set forth and described in the following claims. Accordingly, the drawings and descriptions should be regarded as illustrative in nature and not as restrictive.

BRIEF DESCRIPTION OF THE DRAWING FIGURES

The accompanying drawing figures incorporated herein and forming a part of the specification, illustrate several aspects of the articulating hood pin assembly and the related hood latch assembly and together with the description serve to explain certain principles thereof.

Figure 1:
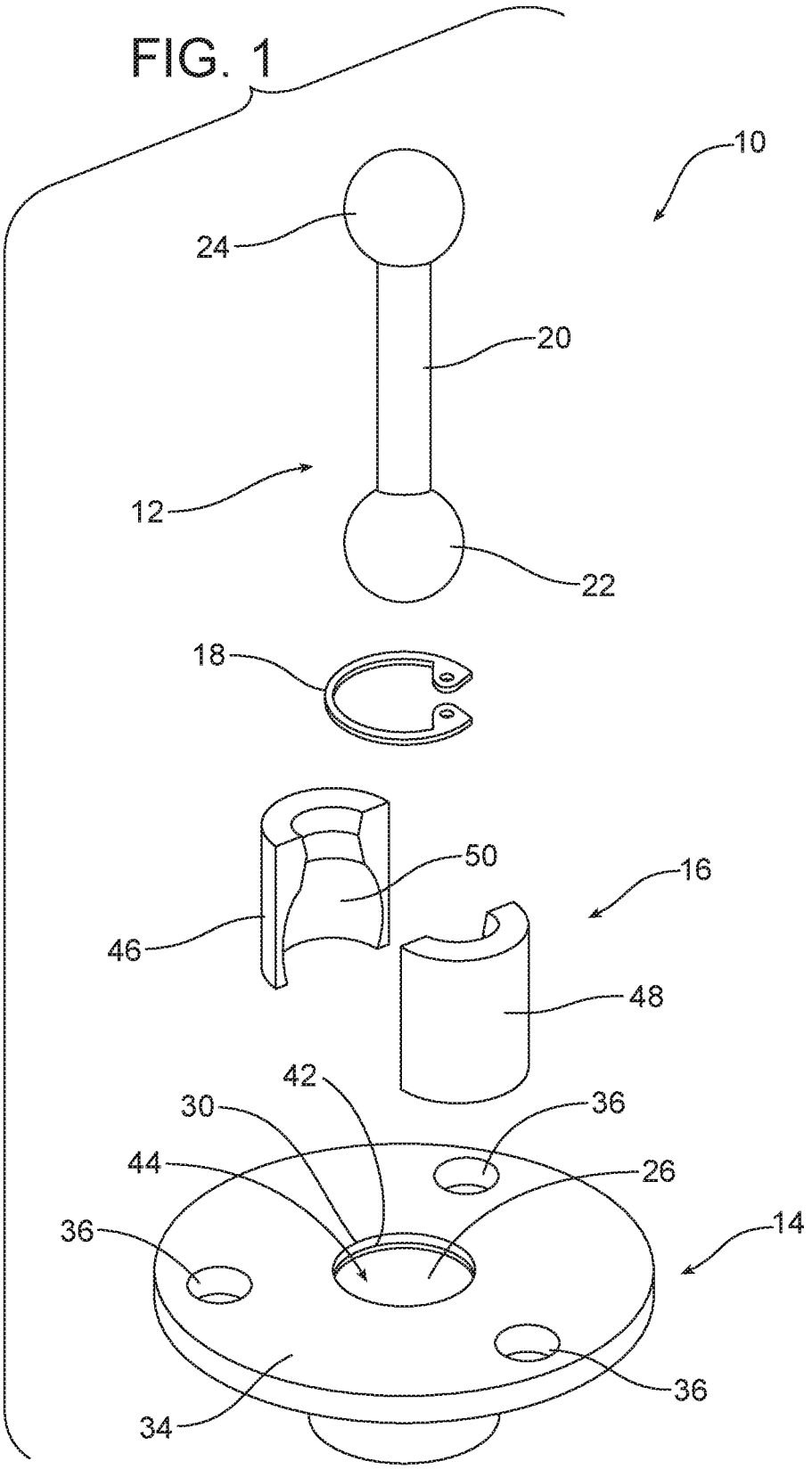
FIG. 1 is an exploded perspective view of the articulating hood pin assembly.
Figure 2:
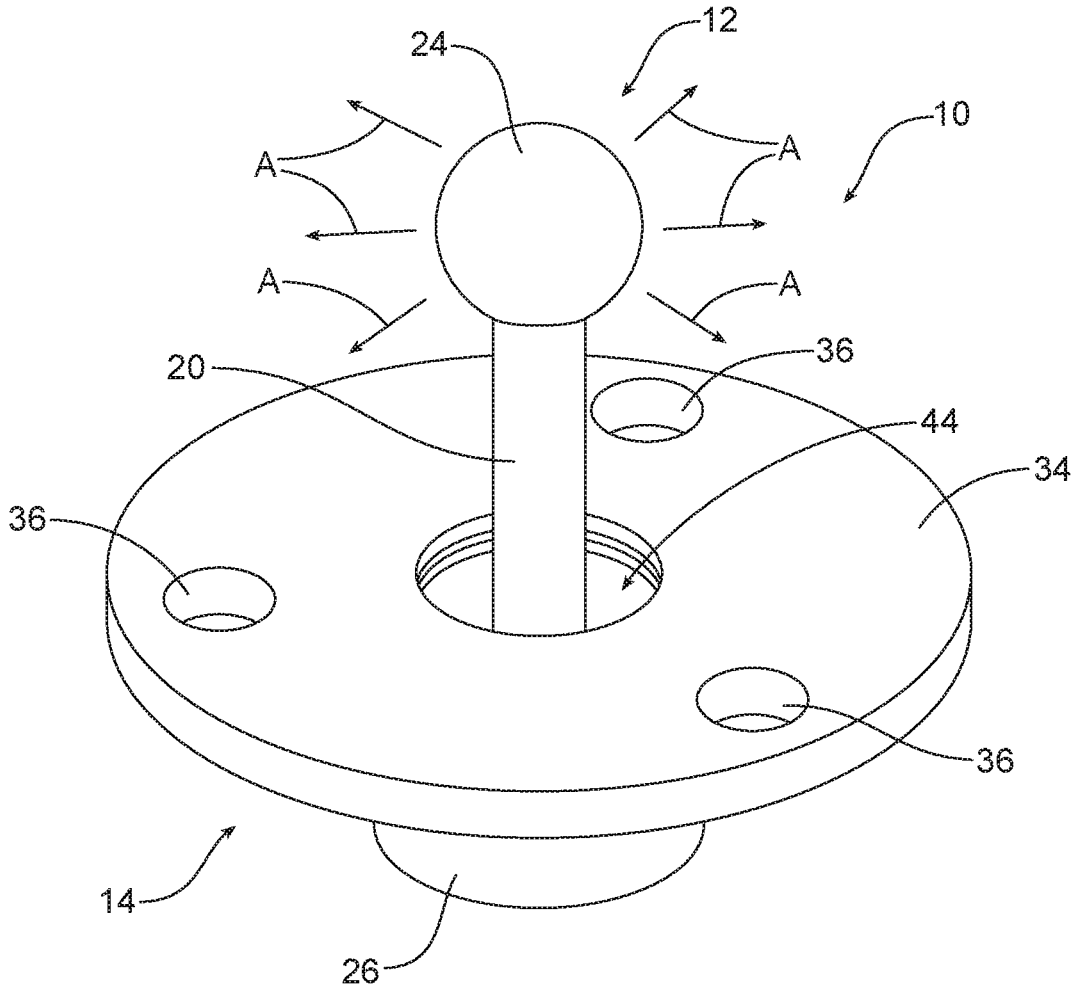
FIG. 2 is a detailed perspective view of the articulating hood pin assembly in the assembled condition.
Figure 3:
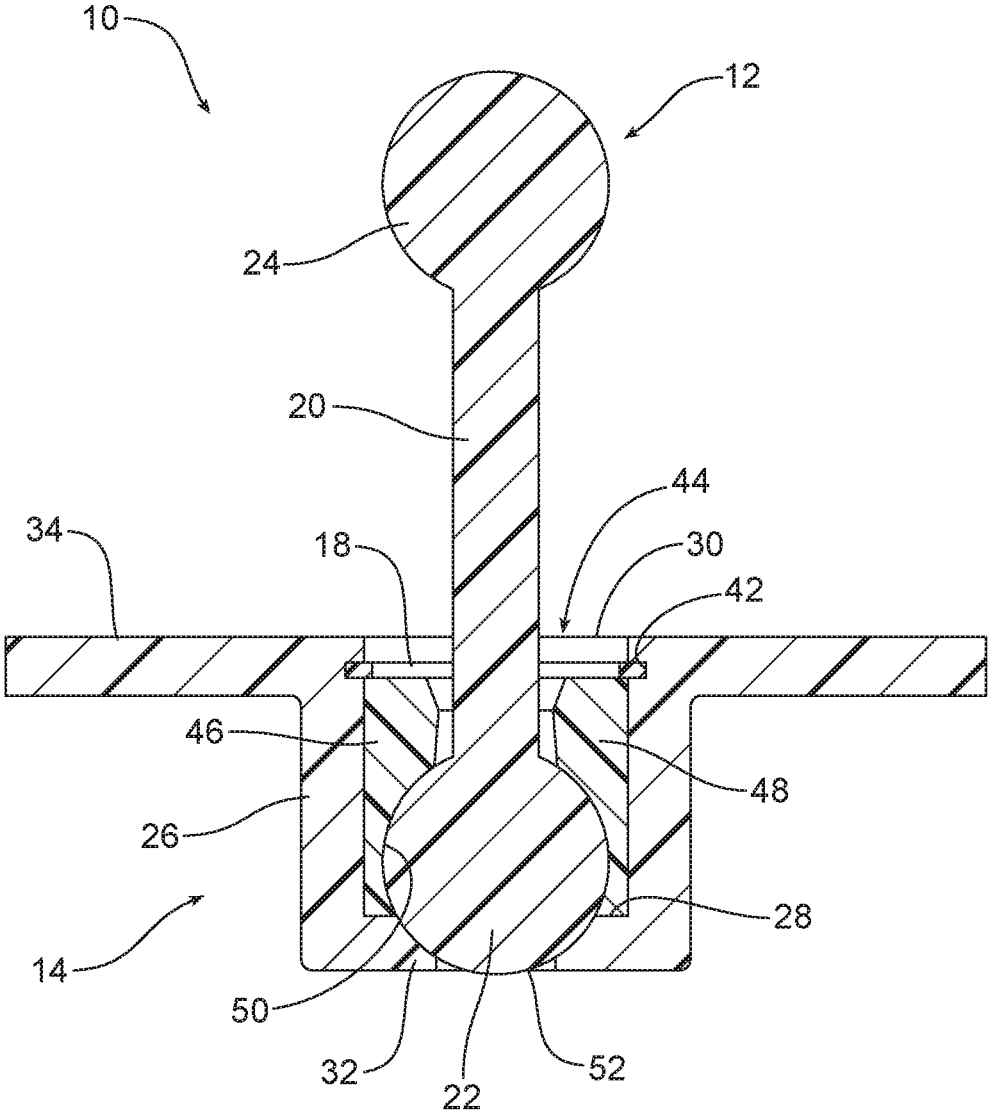
FIG. 3 is a cross-sectional view of the articulating hood pin assembly in the assembled condition.
Figure 4A:
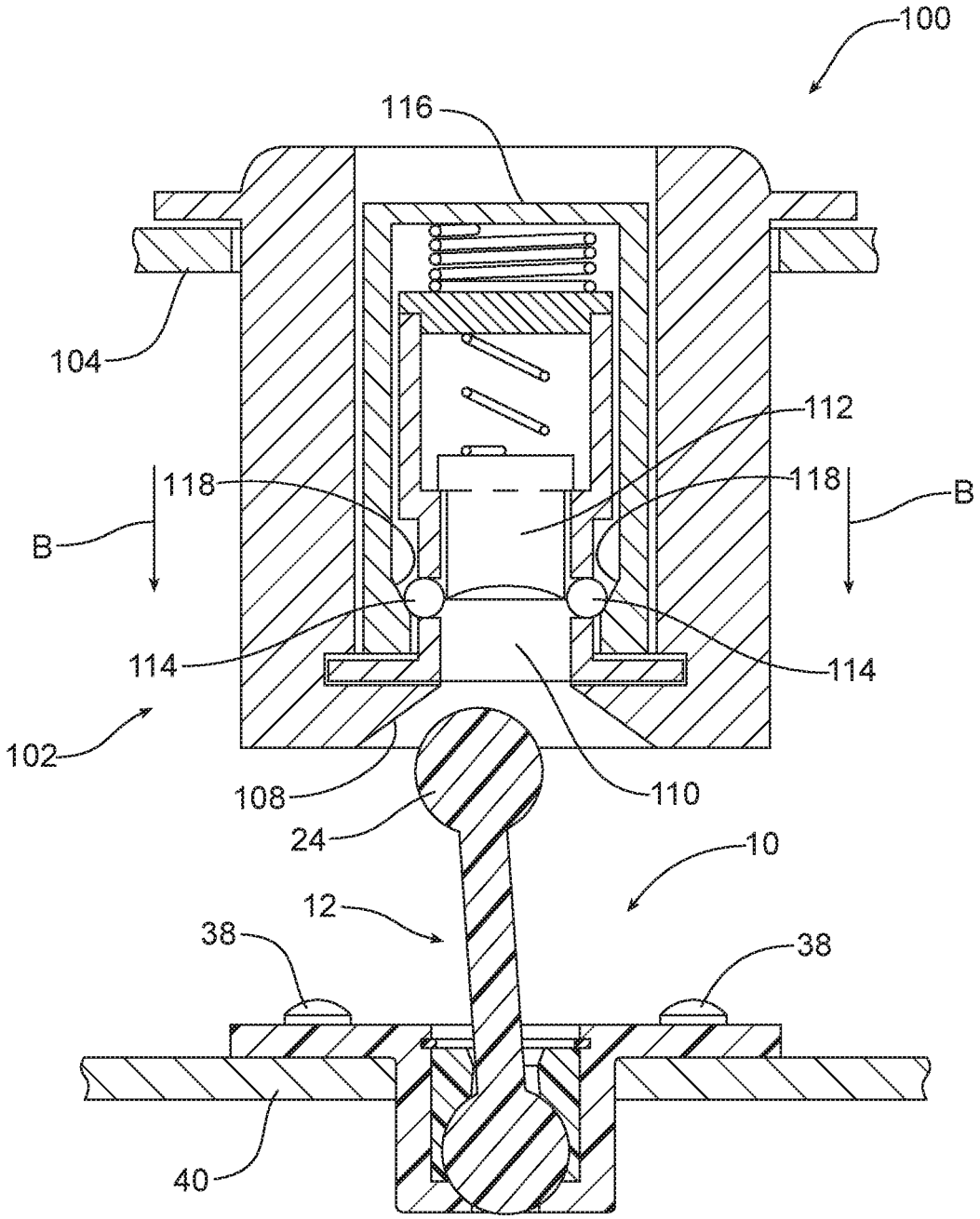

FIG. 4*a* is a cross-sectional view of the hood latch assembly incorporating a latch mechanism and the articulating hood pin assembly illustrated in FIGS. 1-3 wherein the hood latch assembly is illustrated in an unlatched configuration.

Figure 4B:
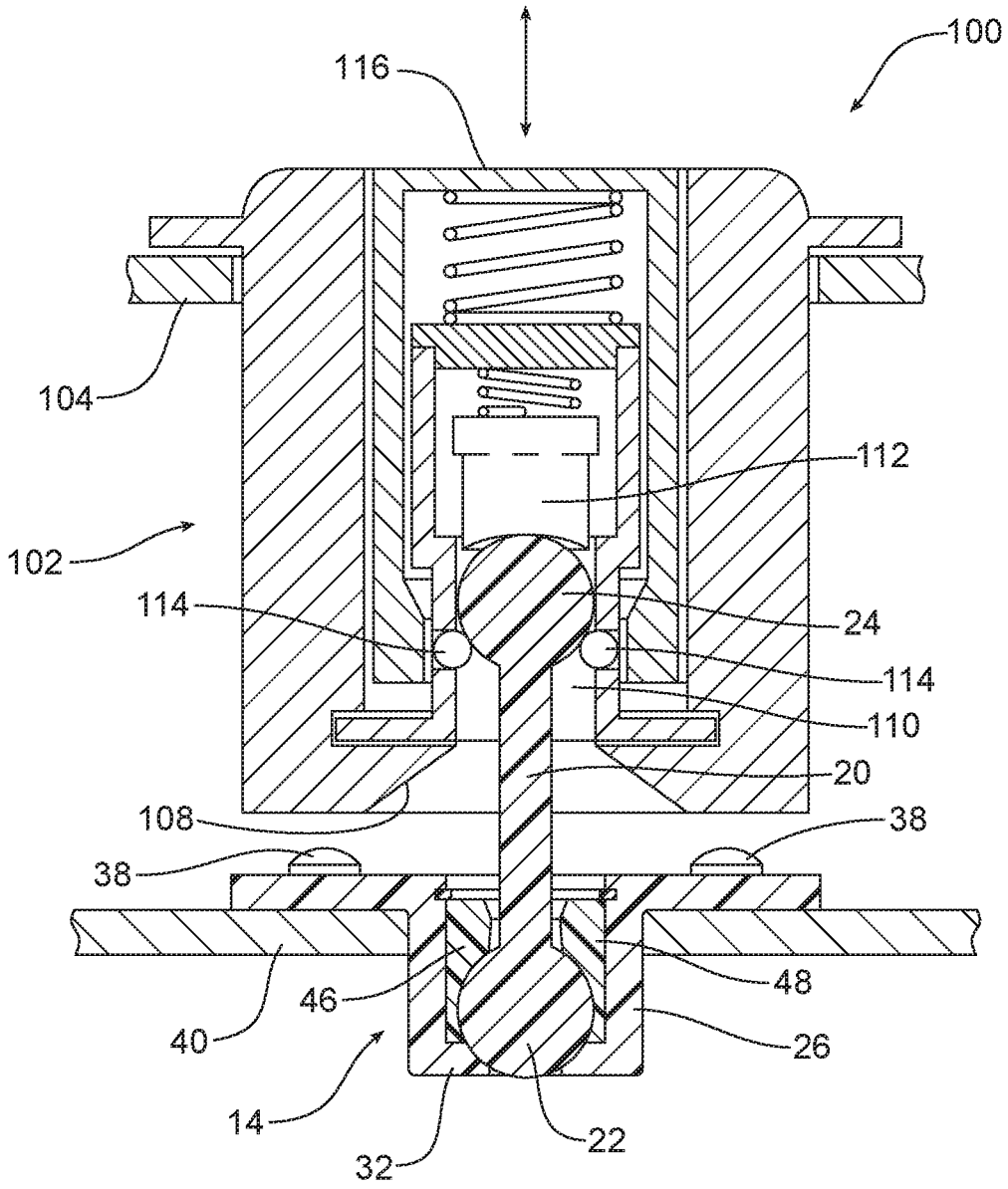

FIG. 4*b* is a view similar to FIG. 4*a* but illustrating the hood latch assembly in a latched configuration.

Reference will now be made in detail to the present preferred embodiments of the articulating hood pin assembly and hood latch assembly, examples of which are illustrated in the accompanying drawing figures.

DETAILED DESCRIPTION

Reference is now made to FIGS. 1-3 illustrating the new and improved articulating hood pin assembly 10 that is particularly suited for accommodating any build variation in a motor vehicle in order to ensure smooth, efficient and proper latching of a hood in the closed position. As illustrated, the articulating hood pin assembly 10 includes a double-ended ball stud 12, a receiver 14, a retention element 16 that holds the double-ended ball stud and a snap ring 18 securing the retention element in the receiver.

More specifically, the double-ended ball stud 12 includes a shank 20 that extends between a first ball 22 and a second ball 24. As illustrated, the first ball 22 and the second ball 24 are provided at opposed ends of the shank 20.

The receiver 14 includes a cylindrical sidewall 26 having a first end 28 and a second end 30. An end wall 32 closes the first end 28. The second end 30 is open.

In the illustrated embodiment, the receiver 14 includes a mounting collar 34 at the second end 30. More specifically, the mounting collar 34 extends concentrically around the opened second end 30. The mounting collar 34 may include a plurality of apertures 36. As illustrated in FIGS. 4*a* and 4*b*, a plurality of fasteners 38 may extend through those apertures 36 in order to secure the receiver 14 to a substrate or support surface 40 within an engine compartment of the motor vehicle.

The receiver 14 also includes a channel 42 formed in the inner face of the cylindrical sidewall 26 adjacent the second end 30. Thus, the channel 42 opens toward or into the blind end bore 44 defined by the cylindrical sidewall 26 and end wall 32 of the receiver 14.

The retention element 16 includes a first section 46 and second section 48. As illustrated in FIGS. 1-3, when the articulating hood pin assembly 10 is assembled, the first section 46 and the second section 48 of the retention element 16 are joined to form a spherical pocket 50 around the first ball 22 of the double-ended ball stud 12. The assembled retention element 16 is then inserted into and received in the blind end bore 44 within the cylindrical sidewall 26 of the receiver 14 so that the first ball 22 of the double-ended ball stud 12 is captured in the retention element 16. It should be appreciated, however, that the smooth sidewall of the spherical pocket 50 and the smooth sidewall of the first ball 22 allow for the free articulation of the double-ended ball stud 12 within the receiver 14 (note action arrows A in drawing FIG. 2). This is what allows the articulating hood pin assembly 10 to readily accommodate for build variation. The assembly of the articulating hood pin assembly 10 is completed by then inserting the snap ring 18 in the channel 42. When seated and received in the channel 42, the snap ring 18 projects from the channel to partially close the second end 30 of the receiver 14 and provide a projecting shoulder to capture the retention element 16 within the cylindrical sidewall 26 of the receiver 14.

Reference is now made to FIGS. 4*a* and 4*b* illustrating the new and improved hood latch assembly 100. FIG. 4*a* illustrates the hood latch assembly 100 in an unlatched condition while FIG. 4*b* illustrates the hood latch assembly in a latched condition.

As illustrated, the hood latch assembly 100 includes a latch mechanism 102 and the articulating hood pin assembly 10 illustrated in FIGS. 1-3 and described in detail above. In the illustrated embodiment, the latch mechanism 102 is mounted to or carried on the hood 104 of a motor vehicle while the receiver 14 of the articulating hood pin assembly 10 is carried or mounted to a support member or substrate 40 within the engine compartment. As the hood 104 is closed (note action arrows B), the projecting second ball 24 at one end of the double-ended ball stud 12 is directed by the tapered entry 108 into the latch receiver 110. Advantageously, the free movement of the double-ended ball stud 12 provided by the articulating hood pin assembly 10 accommodates build variation to ensure that the second ball 24 properly seats in the latch receiver 110, engaging the locking piston 112 until fully seated within the latch receiver 110 and securely latched in the closed position by the spring-loaded retaining balls 114. See FIG. 4*b*.

In order to open the hood 104, one simply depresses the push button actuator 116 of the latch mechanism 102. The sloped walls 118 on the push button actuator 116 provide the necessary clearance for the spring-loaded retaining balls 114 to move radially outward from the ball stud 12 (see FIG. 4*a*) thereby allowing the second ball 24 to pass out of the latch receiver 110 and releasing the hood 104 to be opened.

The articulating hood pin assembly 10 provides a number of benefits and advantages. The articulating hood pin assembly 10 comprises four simple and inexpensive component parts, the double-ended ball stud 12, the receiver 14, the retention element 16 and the snap ring 18. The articulating hood pin assembly 10 functions in a manner that allows the double-ended ball stud 12 to freely articulate in the manner of a joystick so as to better accommodate for build variation and thereby ensure smooth, efficient and proper latching of a hood 104 of a motor vehicle in a closed or latched condition as illustrated in FIG. 4*b*.

The foregoing has been presented for purposes of illustration and description. It is not intended to be exhaustive or to limit the embodiments to the precise form disclosed. Obvious modifications and variations are possible in light of the above teachings. For example, a water drain feature 52, in the form of a drain hole, may be provided in the end wall 32 of the receiver 14 in order to prevent the capture of water within the cylindrical sidewall 26 and end wall 32 of the receiver. See FIG. 3. Further, while the retention element 16 of the illustrated embodiment includes a first section 46 and a second section 48, it should be appreciated that the retention element 16 may include a different number of sections if desired. All such modifications and variations are within the scope of the appended claims when interpreted in accordance with the breadth to which they are fairly, legally and equitably entitled.

What is claimed:

1. An articulating hood pin assembly for a motor vehicle, the articulating hood pin assembly comprising:

a double-ended ball stud including a shank extending between a first ball shaped end of the stud and a second ball shaped end of the stud;

a receiver configured to be mounted to a support surface of a vehicle body;

a retention element held in said receiver, said retention element engaging and holding the first ball shaped end of said double-ended ball stud; and a snap ring engaging the receiver and securing said retention element in said receiver.

2. The articulating hood pin assembly of claim 1, wherein said receiver includes a cylindrical sidewall having a first end and a second end and an end wall closing said first end.

3. The articulating hood pin assembly of claim 2, further including a channel formed in said cylindrical sidewall adjacent said second end.

4. The articulating hood pin assembly of claim 3, wherein said retention element includes a first section and a second section joined together to form a spherical pocket adapted to receive and capture the first ball.

5. The articulating hood pin assembly of claim 4, wherein said retention element is received within said cylindrical sidewall.

6. The articulating hood pin assembly of claim 5, wherein said snap ring is received in said channel and projects from said channel to partially close said second end and capture said retention element within said cylindrical sidewall.

7. The articulating hood pin assembly of claim 6, further including a water drain hole in said end wall.

8. The articulating hood pin assembly of claim 7, further including a mounting collar at said second end.

9. The articulating hood pin assembly of claim 8, further including a plurality of fasteners extending through a plurality of apertures in said mounting collar.

10. A hood latch assembly for a motor vehicle, the hood latch assembly comprising:

a latch mechanism configured to be mounted to a vehicle hood; and an articulating hood pin assembly configured to be mounted to a support surface of a vehicle body, the latch mechanism and the articulating hood pin assembly being relatively displaceable with respect to each other between a locked position, where part of the articulately hood pin assembly is held within said latch mechanism, and an unlocked position, where the articulately hood pin assembly is free of said latch mechanism, said articulating hood pin assembly including (a) a double-ended ball stud including a first ball shaped end and a second ball shaped end, (b) a receiver, (c) a retention element held in said receiver and adapted for holding said first ball shaped end of said double-ended ball stud, and (d) a snap ring engaging the receiver and securing said retention element in said receiver.

11. The hood latch assembly of claim 10, wherein said double-ended ball stud includes a shank extending between, the first ball shaped end and the second ball shaped end.

12. The hood latch assembly of claim 11, wherein said receiver includes a cylindrical sidewall having a first end and a second end and an end wall closing said first end.

13. The hood latch assembly of claim 12, wherein said cylindrical sidewall further includes a channel adjacent said second end.

14. The hood latch assembly of claim 13, wherein said retention element includes a first section and a second section joined together to form a spherical pocket adapted to receive and capture the first ball.

15. The hood latch assembly of claim 14, wherein said retention element is received within said cylindrical sidewall.

16. The hood latch assembly of claim 15, wherein said snap ring is received in said channel and projects from said channel to partially close said second end and capture said retention element within said cylindrical sidewall.

17. The hood latch assembly of claim 16, wherein said latch mechanism is mounted to a hood and said receiver is mounted to a substrate within an engine compartment.

* * * * *